United States Patent [19]

Woodman

[11] Patent Number: 4,821,481

[45] Date of Patent: Apr. 18, 1989

[54] LATTICE AND METHOD OF MAKING SAME

[76] Inventor: Richard C. Woodman, 2186 Ellwyn Dr., Atlanta, Ga. 30341

[21] Appl. No.: 175,142

[22] Filed: Mar. 30, 1988

[51] Int. Cl.[4] ..... E04C 2/42

[52] U.S. Cl. ..... 52/664; 52/665; 411/508; 411/908

[58] Field of Search ..... 52/664, 665; 24/458, 24/545; 403/388, 908.1; 411/508 X, 509, 510, 908 X, 913

[56] References Cited

U.S. PATENT DOCUMENTS

D. 291,278 8/1987 Hill ..... 411/508 X

FOREIGN PATENT DOCUMENTS 1296529 11/1972 United Kingdom ..... 52/665

*Primary Examiner*—John E. Murtagh
*Assistant Examiner*—Jerrold D. Johnson
*Attorney, Agent, or Firm*—Thomas & Kennedy

[57] ABSTRACT

A lattice comprises a set of tubular strips fastened together at designated crossings that have openings formed in the surface of each strip that faces and is overlayed by the other strip. The tubular strips are fastened together by resilient fasteners that are snapped into the strip openings.

14 Claims, 1 Drawing Sheet

LATTICE AND METHOD OF MAKING SAME

TECHNICAL FIELD

This invention relates generally to lattices, and particularly to lattices of the type formed of plastic strips.

BACKGROUND OF THE INVENTION

Lattices made of interwoven or crossed wooden strips have long been used to provide air and light permeable walls for buildings of various types. Recently, lattices have been made of plastic strips such as from cellular blown polyvinylchloride (PVC). These plastic lattices offer distinct advantages over wooden lattices including the facts that they have much greater longevity, do not need to be painted or repainted, are lightweight, relatively easy to erect, termite-proof and mildew resistant.

Though prefabricated plastic lattices do provide decided improvements to those of wooden construction, they still are lacking in some attributes. Specifically, their large sizes render them difficult to store and transport. That they are prefabricated as large size panels limits their versatility with regard to dimensions and color patterns. Thus, if a lattice could be devised that had these attributes in addition to those already associated with plastic lattices in general, a distinct advance in the art would be achieved. It is to the provision of such therefore that the present invention is primarily directed.

SUMMARY OF THE INVENTION

In one form of the invention a lattice comprises a plurality of tubular strips fastened together at designated crossings that have openings formed in the surface of each strip that faces and is overlaid by the other strip. The tubular strips are fastened together by fasteners that are snapped into both of the tubular strip openings at the crossings.

In another form of the invention a lattice comprises a plurality of flat strips adapted to be fastened flushly together at designated crossings where recesses are formed in one of their flat surfaces. A plurality of resilient fasteners are provided for fastening the strips together at the designated crossings with the fasteners sized and shaped to be snap fitted into the recesses that are aligned at two designated crossings of the two strips.

In yet another form of the invention a method is provided for constructing a lattice of the type that has a set of flat strips formed with recesses in a flat surface at designated strip crossings. The strips are fastened together at the designated crossings by snapping resilient fasteners into aligned recesses of the strips that are placed across each other at the crossings.

DETAILED DESCRIPTION

Figure 1:
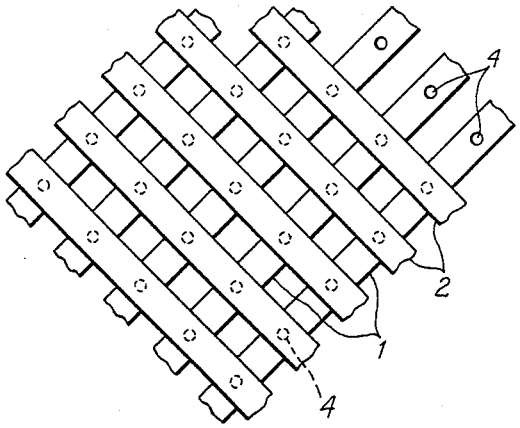
FIG. 1 is a front view of a fragment of a lattice embodying principles of the present invention.
Figure 2:
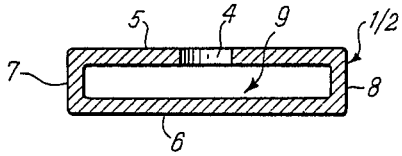
FIG. 2 is a cross-sectional view of one strip used in the construction of the lattice illustrated in FIG. 1.

With reference next to the drawing there is shown in FIG. 1 a portion of a lattice comprised of a set of plastic strips 1 arranged in parallel, mutually spaced orientation which are overlaid by another set of plastic strips 2 that also are arranged in parallel mutually spaced orientation so as to transverse the strips 1 at right angles thereto. As best in FIG. 2, the strips 1 and 2 are of identical, tubular construction having two principal flat sides 5 and 6 unitarily joined by two other sides 7 and 8 to form a bore or space 9 therein. The side 5 is seen to be formed with an opening or hole 4 that extends completely through it so as to establish communication between the bore 9 and ambience. The holes 4, which may also be characterized and formed as recesses, are located at regular intervals along the side 5 as shown in FIG. 1. These intervals match the center-to-center spacings of the other traversing strips. Thus at each crossing of a strip 1 and 2, two holes 4 are placed in alignment to form a joint channel that extends between the bores 9 of two crossed strips.

Figure 3:
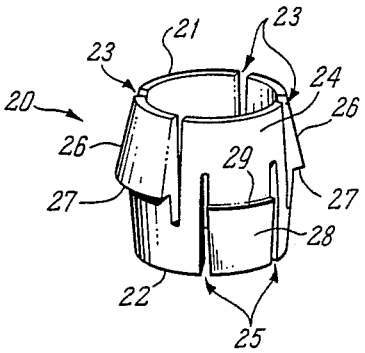
FIG. 3 is a perspective view of a fastener used in fastening the strips of the lattice together at their crossings.

With reference next to FIG. 3 a fastener 20 is shown for use in fastening the strips 1 and 2 together at their crossings. The fastener here is of unitary, plastic construction and in the general shape of a tube having two opposed annular ends 21 and 22. The fastener has four slots 23 formed in a cylindrical wall 24 that extend from the fastener end 21. Similarly, the fastener has four other slots 25 formed in the wall 24 that extend from the opposite end 21 in parallel relation with the slots 23. The fastener is also formed with two wedge-shaped extensions 26 that extend down and outwardly from the end 21 spanning the distance between two adjacent slots 23 so as to form two ledges 27. Similarly, the fastener has two other wedges 28 that extend from the end 22, each spanning a portion of the space between two of the slots 25. The ledges 27 are coplanar as are the two ledges 29 at the ends of the wedges 28. In FIG. 3 one of the two wedges 28 is not visible as it is on the far side of the fastener 20, as pictured in this figure. The two planes in which the ledges 27 and 29 respectively lie are parallel and are spaced apart a distance just slightly greater than double the thickness of one of the principal walls 5 of one of the strip 1 or 2.

Figure 4:
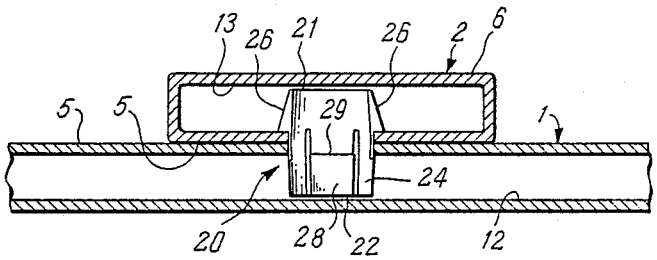
FIG. 4 is a cross-sectional view of two strips that cross each other and are fastened together by the fastener illustrated in FIG. 3.

The lattice of FIG. 1 may be readily and simply constructed by arranging a set of the strips 1 in parallel, spaced relation upon a flat supporting surfaces 5 facing up. Fasteners 20 are then snapped into each of the holes 4 in the strips. This is done by merely inserting either end (here end 22) into the hole which end is sized approximately to match the diameter of the hole 4. As this is done the wedges 28 are drawn against the boundary of the walls of the hole 4. Since the fastener is provided with slots 25 adjacent the wedges 28, enough resiliency is provided to enable the wedges to flex inwardly as they are forced towards the axis of the fastener as they are driven against the walls 4. Once the wedges 28 have passed beneath the inner lip of the wall, they are permitted to spring back outwardly and thereby underlay the inner periphery of the hole along the inside surface of the wall 5. As shown in FIG. 4, the end 22 of the fastener will then be located closely adjacent the inside surface 12 of the wall 6 of strip 1.

Next, the strips 2 are placed as shown in FIG. 1 with their holes 4 aligned with the fasteners that are projecting temporarily out of the holes in the strips 1. By pressing the strips 2 downwardly and mating their holes 4 with the fasteners, the wedges 26 are flexed inwardly by the resiliency provided by the slots 23 until they pass beyond the inside surface of the wall 5 and are thereby permitted to spring back outwardly and snapped into place. Again, the end 21 of the fastener will now be located closely adjacent the inside surface 13 of the strip wall 6 as shown in FIG. 4. The strips 1 and 2 are now permanently fastened together by the fasteners 20 with their abutting walls 5 drawn flushly together.

With this construction of the strips and fasteners, lattices may now be readily erected on site without having to be prefabricated into substantial panel sizes which renders storage and transportation difficult. The basic lattice is formed by strips 1 and 2 which are of identical construction and thereby do not have to be sorted and labeled. This is achieved with fasteners 20 that also are of identical construction and which can be inserted from either end into the holes of either of the sets of strips without orientation. The angle that the strips cross may also be easily varied prior to trimming and fixed framing trimmed as desired.

The resulting lattice has a hard vinyl surface. Being tubular it has enhanced strength over those of solid plastic construction and almost unlimited variety of sizes and patterns can be formed. For example, though the lattice in FIG. 1 is shown to have strips that cross each other at right angles, other angles may be readily constructed by simply pivoting the strips prior to fixed framing. The lattice thus provides individual consumer creativity in the provision of sizes, spacings, geometric and color patterns with strips that may be compactly packaged. No chemicals, glue or tools are needed in forming the main body of the lattice. The flexibility of the joints allows for complete nailing across the top of the lattice panel while permitting expansion and contraction of the panel to occur in an accordion type manner. Conversely, rigid joint lattices may only be nailed at the center of the top edge. The fact that the strips 1 and 2 are of hollow, tubular, thin wall configuration allows for an increase in overall thicknesses of the strips for enhanced strength and aesthetics. The fasteners employed are also totally concealed for further enhanced aesthetics. Thus, a single color fastener may be used for all color lattices since they are concealed.

It thus is seen that a lattice and lattice construction method is provided which provides a distinct advance in the art. It should be understood however that the just described embodiment merely illustrates principles of the invention in a preferred form. Many modifications, additions and deletions may thus be made thereto without departure from the spirit and scope of the invention as set forth in the following claims.

I claim:

1. A lattice comprising a plurality of tubular strips fastened together at designated crossings that have openings formed in the surface of each strip that faces and is overlayed by another strip and with the opposite surface of each strip that faces away from the other strip being closed at said crossings, and wherein said tubular strips are fastened together by fasteners that are concealed from view and which are snapped into said tubular strip openings at said crossings.

2. The lattice of claim 1 wherein said strips are plastic.

3. The lattice of claim 2 wherein said fasteners are plastic.

4. The lattice of claim 1 wherein said openings are round.

5. The lattice of claim 1 wherein said fasteners are resilient.

6. The lattice of claim 5 wherein said resilient fasteners are tubular.

7. The lattice of claim 6 wherein said tubular strips have outside and inside surfaces and said resilient tubular fasteners have axially spaced flanges sized to overlap inside surfaces of said tubular strips about the peripheries of said openings.

8. A lattice comprising a plurality of flat strips adapted to be fastened flushly together at designated crossings where recesses are formed in one of their flat surfaces, and a plurality of resilient fasteners for fastening said strips together at said designated crossings with each fastener sized and shaped to snap-fitted into two of said recesses that are aligned at two designated crossings of two of said strips so as to be fully contained within said strips and concealed from view.

9. The lattice of claim 8 wherein each of said recesses has an annular lip located adjacent said flat surface.

10. The lattice of claim 9 wherein each of said resilient fasteners is annular.

11. The lattice of claim 10 wherein each of said resilient fasteners has a set of wedges that taper outwardly as they extend from ends of the annular fasteners.

12. In a lattice that has hollow strips which overlap at strip crossings where a hole or recess is formed in each strip, the improvement comprising a set of resilient fasteners fastening the hollow strips together at the crossings by being snapped into the strip holes or recesses so as to reside entirely inside of said hollow strips and strips holes or recesses concealed from view and with each resilient fastener being of unitary generally tubular configuration having a plurality of slots that extend axially from each end of the fastener and a plurality of wedges that flare outwardly as they extend axially from each of said ends.

13. The improvement in lattices of claim 12 wherein each fastener has a pair of diametrically opposed wedges adjacent each of said fastener ends.

14. The improvement in lattices of claim 13 wherein the pair of wedges located adjacent one of said fastener ends is angularly offset from the pair of wedges located adjacent the other of said fastener ends.

* * * * *